US006413154B1

(12) United States Patent
Togawa et al.

(10) Patent No.: US 6,413,154 B1
(45) Date of Patent: Jul. 2, 2002

(54) POLISHING APPARATUS

(75) Inventors: Tetsuji Togawa, Chigasaki; Takeshi Sakurai; Nobuyuki Takada, both of Fujisawa; Shoichi Kodama, Shinagawa-ku; Hiromi Yajima, Yokohama, all of (JP)

(73) Assignees: Ebara Corporation, Tokyo; Kabushiki Kaisha Toshiba, Kanagawa, both of (JP)

( * ) Notice: Subject to any disclaimer, the term of this patent is extended or adjusted under 35 U.S.C. 154(b) by 0 days.

(21) Appl. No.: 09/582,845

(22) PCT Filed: Jan. 21, 1999

(86) PCT No.: PCT/JP99/00203

§ 371 (c)(1),
(2), (4) Date: Sep. 11, 2000

(87) PCT Pub. No.: WO99/37441

PCT Pub. Date: Jul. 29, 1999

(30) Foreign Application Priority Data

Jan. 21, 1998 (JP) ..... 10-123924

(51) Int. Cl.[7] ..... B24B 29/00

(52) U.S. Cl. ..... 451/285; 451/5; 451/41; 451/53; 451/60; 451/288

(58) Field of Search ..... 451/5, 41, 53, 451/60, 285, 288

(56) References Cited

U.S. PATENT DOCUMENTS 4,059,929 A * 11/1977 Bishop ..... 451/60
5,605,487 A * 2/1997 Hileman et al. ..... 451/5
6,051,499 A * 4/2000 Tolles et al. ..... 438/692

FOREIGN PATENT DOCUMENTS

EP 0 648 575 4/1995

* cited by examiner

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

A polishing apparatus can produce a uniform quality of polished products by supplying a polishing solution consistently without being affected by any disturbances in the solution supply source. The polishing apparatus comprises: a polishing section for polishing a workpiece by pressing the same against a polishing tool; a solution piping assembly to be connected to an external solution supply device for transferring a polishing solution therefrom to the polishing section; and a solution suction device provided in the solution piping assembly for introducing the polishing solution from the solution supply device to the polishing section at a desired flow rate.

19 Claims, 4 Drawing Sheets

POLISHING APPARATUS

TECHNICAL FIELD

The present invention relates to polishing apparatuses, and relates in particular to a polishing apparatus to provide consistent polishing by supplying polishing solution consistently regardless of disturbances in a polishing solution supply facility.

BACKGROUND ART

Advances in integrated circuit devices in recent years have been made possible by ultra fine wiring patterns and interline spacing. The trend towards high density of circuit integration leads to a requirement of extreme flatness of a substrate surface to satisfy the shallow depth of focus of stepper printer in photolithographic reproduction of microcircuit patterns.

One method of producing such a flat surface on a semiconductor wafer surface is to use a polishing apparatus having a polishing tool (for example, a polishing table having a polishing cloth) and a wafer holding section for holding the wafer and pressing and sliding the wafer against the polishing tool while supplying a polishing solution to the polishing surface. Such an apparatus can perform not only mechanical polishing but also chemical polishing using an alkaline or acidic polishing solution.

Polishing solution is normally prepared by mixing a stock solution and a dilution liquid in a mixing tank, which is used to supply a mixed solution through a delivery pipe to the solution nozzle of the polishing apparatus. The polishing facility may have associated cleaning mechanisms. When a plurality of polishing apparatuses are arranged in parallel to perform production of substrates, one solution supply device is normally provided for several polishing apparatuses. Also, in a production plant based on an even greater number of polishing apparatuses, consideration is given to a polishing solution delivering system having a stem pipe (circulating pipe) extending from one mixing tank and circulating around the plant and branch pipes branching from the stem pipe for delivering solution to each polishing apparatus, in an effort to reduce the operating and facility costs.

However, in such a conventional technology to supply the solution to each polishing apparatus by using a circulation pump, it is necessary to select a delivery capacity for the circulation pump so that the capacity would be sufficient to deliver a necessary quantity of solution at full plant operation, thus resulting in a high facility cost. Furthermore, because of fluctuations in solution supply rate caused by pressure changes in the delivery pipes due to changes in the number of operating polishing apparatuses, it is difficult to maintain a stable flow of solution of a given concentration. This affects the quality of polished products produced at various polishing apparatuses within the plant. It will be necessary to provide expensive flow control devices and complex process control methodology to overcome such flow rate fluctuation to provide a steady flow of polishing solution of a consistent quality to each polishing apparatus.

SUMMARY OF THE INVENTION

It is an object of the present invention to provide a polishing apparatus that enables production of a uniform quality of polished products by supplying a polishing solution consistently without being affected by any disturbances in the solution supply source.

The object has been achieved by providing a polishing apparatus comprising: a polishing section for polishing a workpiece by pressing the same against a polishing tool; a solution piping assembly to be connected to an external solution supply device for transferring a polishing solution therefrom to the polishing section; and a solution suction device provided in the solution piping assembly for introducing the polishing solution from the solution supply device to the polishing section at a desired flow rate.

Accordingly, an independent polishing unit with high flexibility is presented that can operate regardless of the presence or absence of fluid transport means for the polishing solution in the external polishing solution source. Even if a fluid transport means is to be provided in the external source of polishing solution, it is not necessary to choose an excessive capacity for the fluid transport means, and it is only necessary to operate a fluid transport means to suit the polishing load of polishing apparatuses. Thus, wasteful facility and operating costs can be eliminated.

The solution piping assembly may be provided with a flow control device for adjusting flow rates of polishing solution through the solution piping assembly. Accordingly, polishing solution can be supplied at a flow rate to suit the needs of individual polishing apparatuses, thereby providing stable and accurate flow control.

The solution piping assembly may be provided with a smoother for smoothing out pulsation of the polishing solution flowing therethrough. Accordingly, even when flow pulsation is produced in the fluid transport means over small time intervals, such as in peristaltic pumps, stable flow of polishing solution can be supplied.

The present polishing apparatus can supply polishing solution consistently regardless of any disturbances in the solution supply device so that a polishing operation can be carried out correctly at individual polishing apparatuses. When an external fluid transport device is utilized in the external solution supply source, it is not necessary to design an excessive capacity so that wasteful facilities and operating costs can be eliminated, thus resulting in integration of a solution supply facility even in a relatively large production plant having a large number of polishing apparatuses operating therein. Capital cost and space allowances can thus be lowered to bring genuine benefits to industries concerned with advanced semiconductor device production.

The polishing apparatus may be assembled in a polishing unit together with a storing section for storing a workpiece, and a transporting device for transporting the workpiece between the polishing apparatus and the storing section.

The polishing apparatus may be assembled in a polishing system together with a solution supply device, and a solution distribution pipe for distributing a polishing solution from the solution supply device to the polishing apparatus, in which the solution piping assembly is connected to the solution distribution pipe.

DESCRIPTION OF THE PREFERRED EMBODIMENTS

Figure 1:
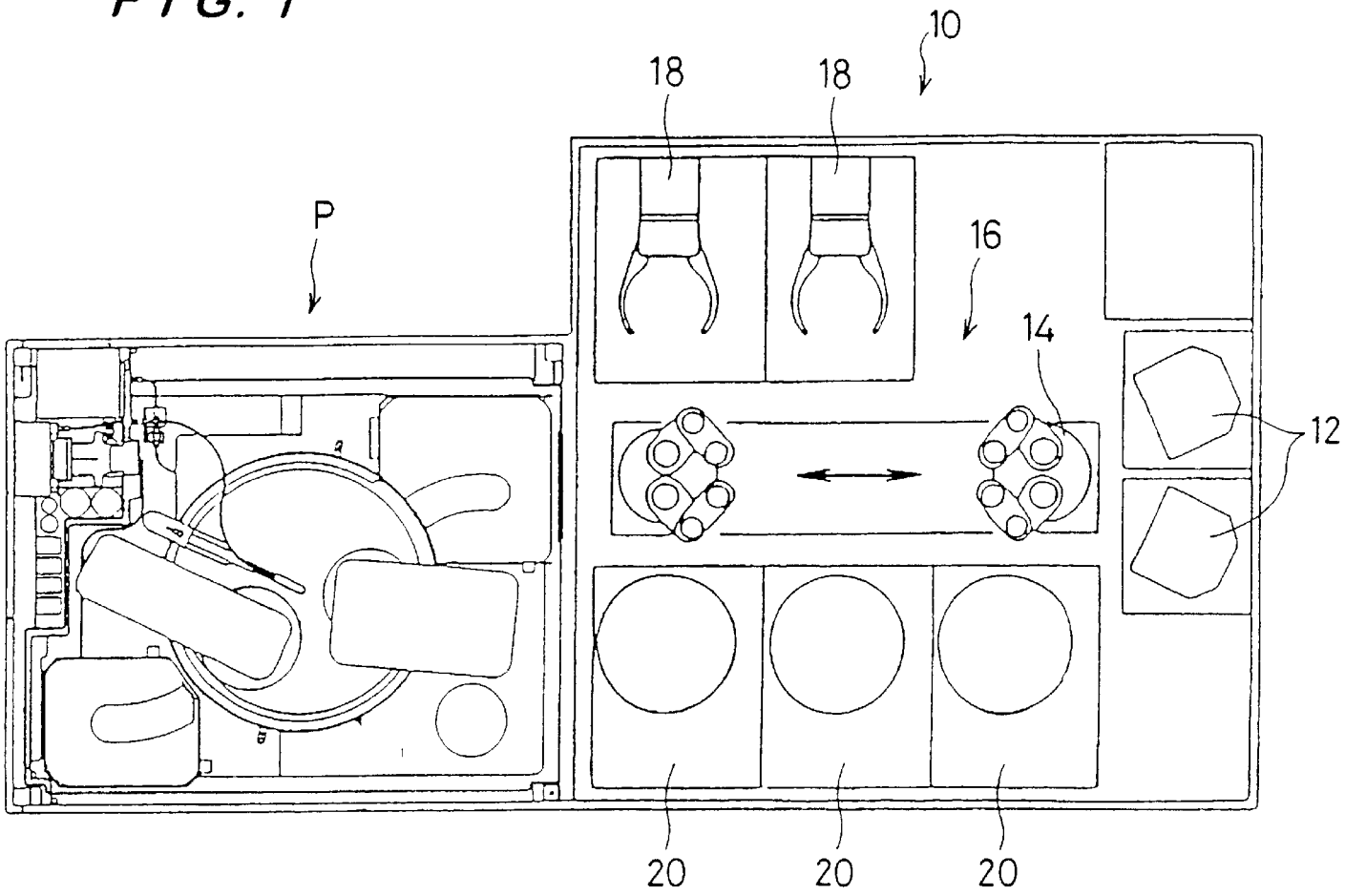
FIG. 1 is a plan view of the arrangement of a polishing unit in the polishing apparatus of the present invention.

In the following, preferred embodiments will be presented with reference to the drawings. FIG. 1 shows an arrangement of the polishing apparatus P incorporated into a polishing unit 10. Polishing unit 10 includes: a load/unload unit 12 disposed on the opposite-side of the polishing apparatus P; a transport device 16 having a robotic device 14 movable between the polishing apparatus P and the load/unload unit 12; and a plurality of inverters 18 and cleaners (or a dryer) 20 disposed on both sides of the transport device 16.

Figure 2:
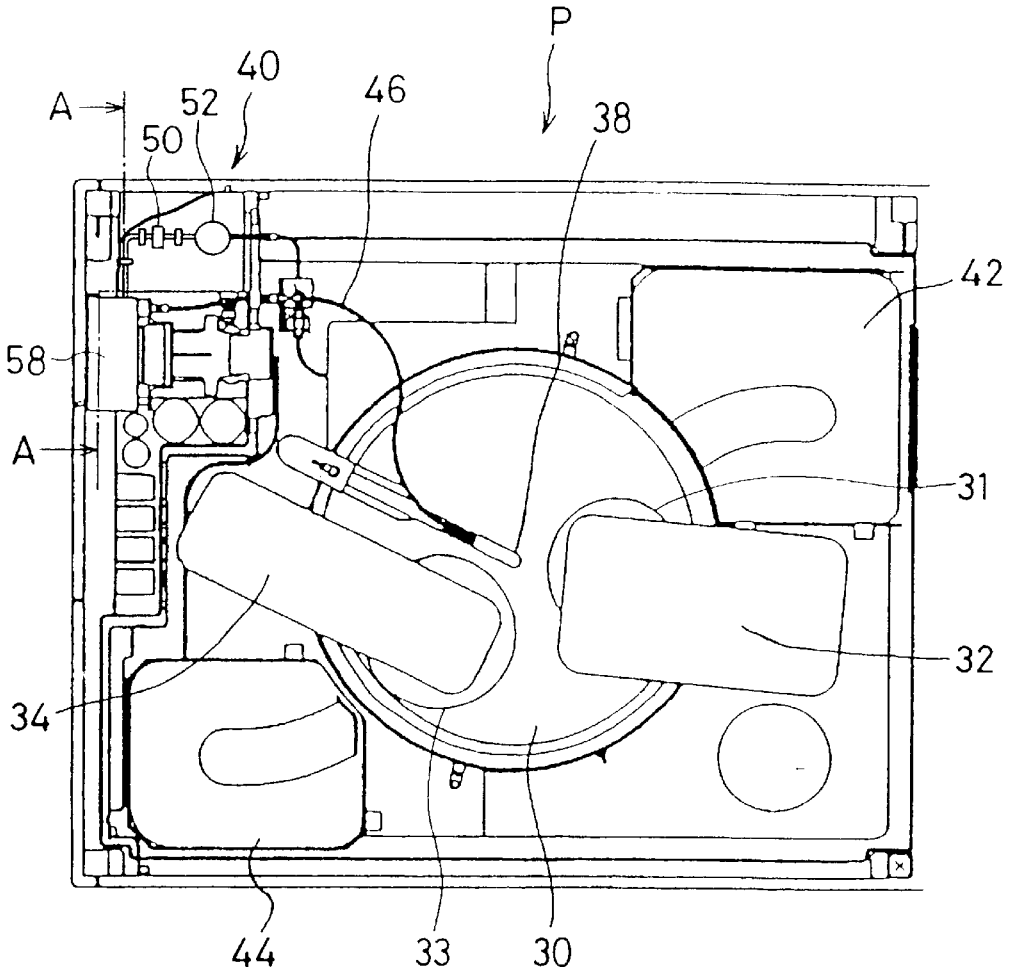
FIG. 2 is an enlarged plan view of the polishing apparatus shown in FIG. 1.

As shown in an enlarged view in FIG. 2, polishing apparatus P includes: a turntable 30 having a polishing cloth bonded to a top thereof; a top ring unit 32 having a top ring 31 for holding a wafer and pressing the wafer towards the turntable surface; a dresser unit 34 having a dressing member 33 for conditioning the polishing cloth; and a polishing solution supply section 40 for steadily supplying a polishing solution from a solution supply device 36 by way of a solution nozzle 38. Auxiliary devices include: a wafer pusher 42 for exchanging a wafer between the top ring 31 and the robotic device 14; and a cleaning section 44 for washing the dressing member 33 when it is not being used. The polishing apparatus P is constructed so that it may be placed in an isolated environment to prevent other devices in polishing unit 10 from being contaminated with splattered polishing solution.

Figure 3:
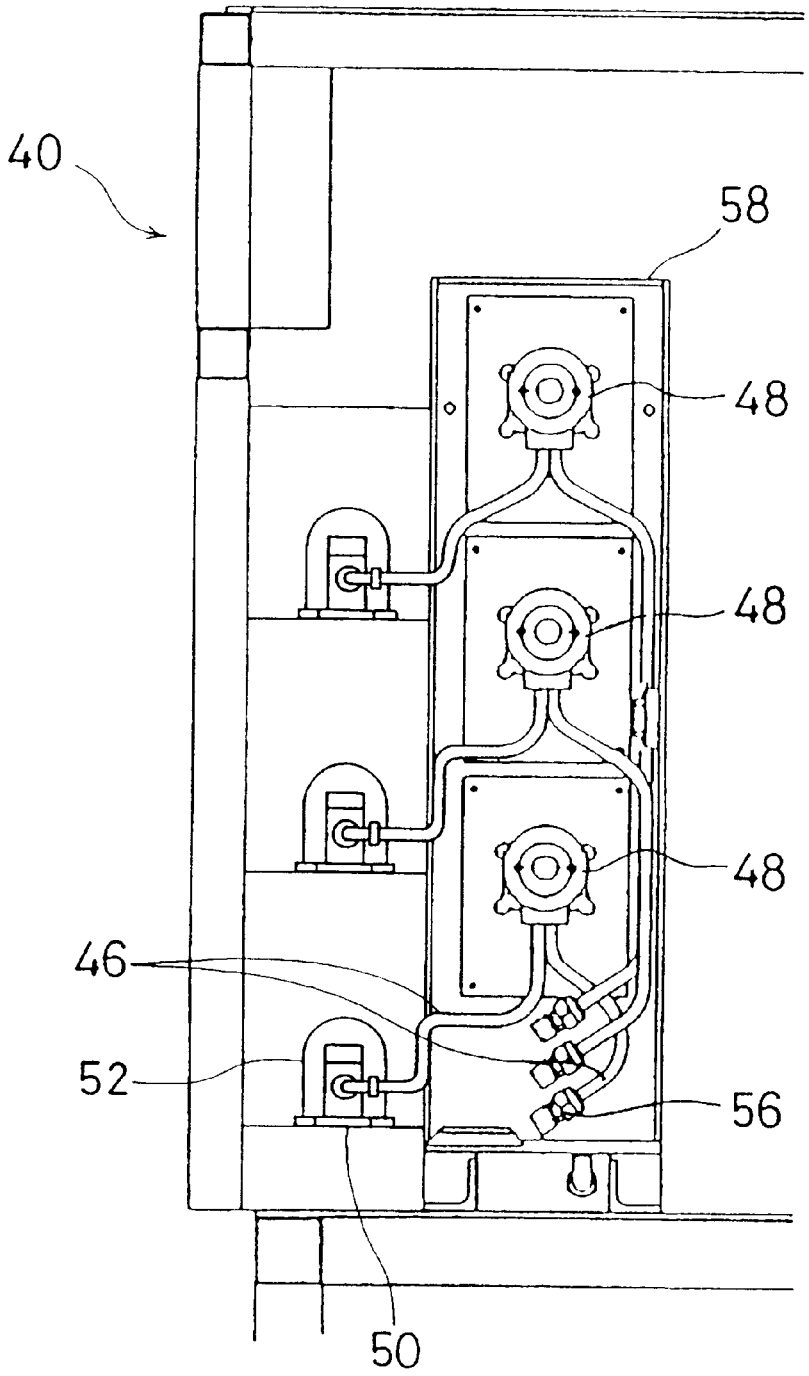
FIG. 3 is a front view of the key section of the apparatus shown in FIG. 2.
Figure 4:
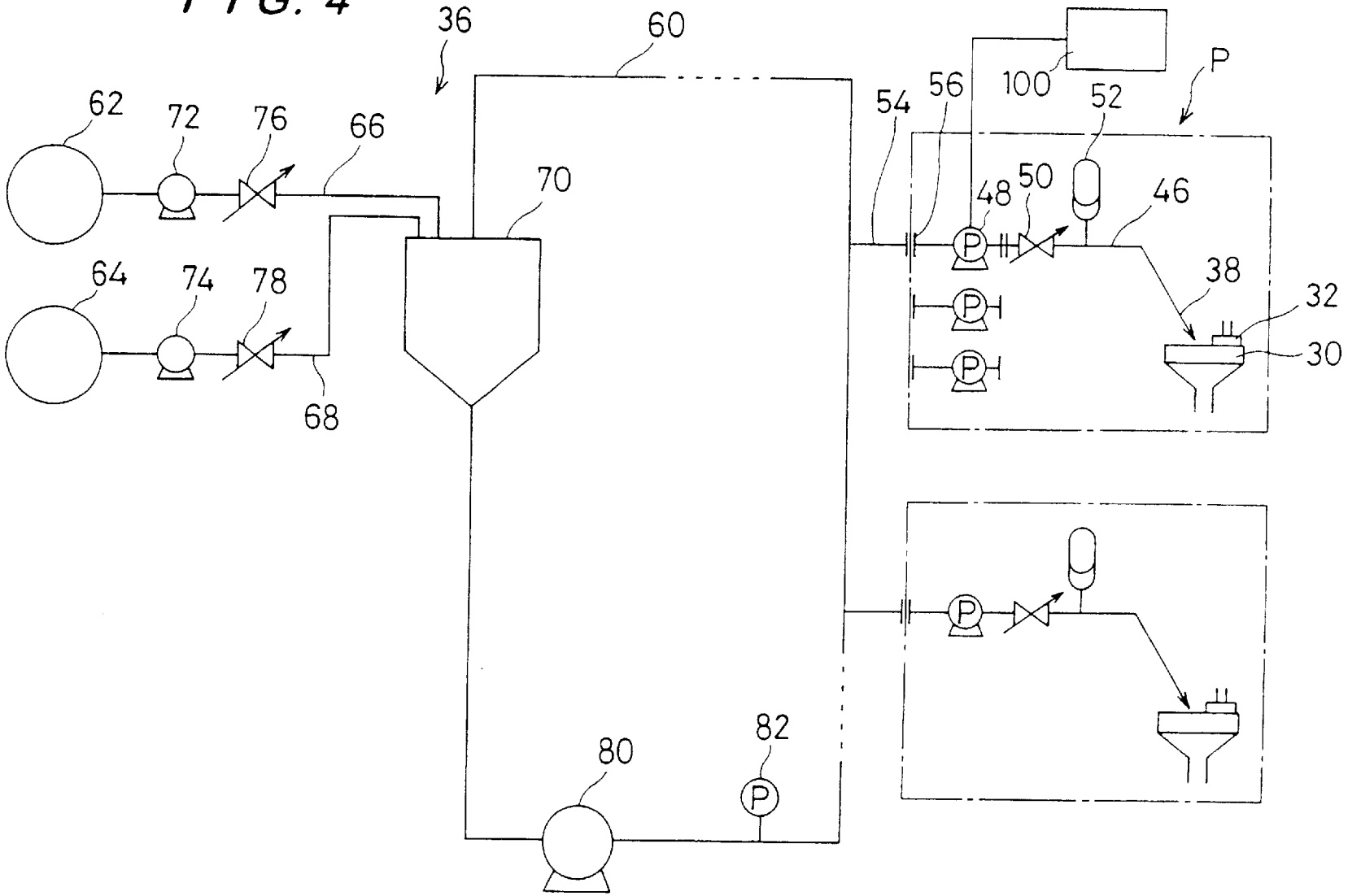
FIG. 4 is a schematic diagram showing the flow paths of the polishing solution through the polishing system of the present invention.

Polishing solution supply section 40 is provided with a solution delivery pipe 46 connected to solution nozzle 38, a solution suction pump 48 provided in the path of the delivery pipe 46, a flow adjusting valve 50; and an accumulator 52 (refer 25 to FIG. 4). Solution delivery pipe 46 has a coupling 56 at one end, which is connected to a supply pipe 54 of the solution supply device 36. As shown in more detail in FIG. 3, there are three suction pumps 48, each a well known peristaltic pump operating through a flexible tube, housed vertically inside a casing 58.

Obviously, the type, number and arrangement of suction pumps 48 are not limited to this example. Also, such pumps may be connected in series or parallel, and some may act as reserves. Further, the pumps may be switched through switching valves, and the manner of connecting the coupling to the pipe may be altered.

Flow rates through the peristaltic pumps 48 can be adjusted by adjusting the revolution speed, but in this embodiment, flow control valve 50 is used to provide a more precise adjustment of flow rates and suppress flow rate pulsation (a problem inherent in peristaltic pumps) to some extent. Accumulator 52 helps to further control pulsation to provide a stable supply of polishing solution to the solution nozzle 38.

FIG. 4 shows an overall arrangement of the polishing system provided by connecting the polishing apparatus P to the solution supply device 36. This polishing system is provided with the solution supply device 36, a plurality of polishing apparatuses P in this embodiment, and circulation pipes 60 to deliver the solution to the vicinity of the polishing apparatuses P.

Solution supply device 36 includes: a stock solution tank 62 for storing a stock: solution; a dilution liquid tank 64 for storing a liquid to dilute the stock solution to a specific concentration; and a mixing tank 70 for merging the stock solution and dilution liquid supplied from the tanks 62, 64 through flow pipes 66, 68 to produce a polishing solution of a specific concentration. Flow pipes 66, 68 are respectively provided with pumps 72, 74 to transport the fluids under pressure, and flow control valves 76, 78. Dilution liquid may also be obtained from a plant source in a form of deionized water supplied at a controlled flow rate. Stock solution may include an acidic, alkaline or neutral solution containing abrasive particles such as silica-gel, depending on the nature of the workpiece, and dilution liquid is normally deionized water containing no harmful impurities.

Circulation pipe 60 is provided with a circulation pump 80, for circulating the polishing solution, and a pressure gage 82. Circulation prevents precipitation of abrasive particles due to flow stagnation, so that the delivery pipe can be lengthened to deliver a consistent quality of polishing solution to a plurality of polishing apparatuses P from one solution supply source (mixing tank) 70, thereby lowering the overall cost of the polishing system.

Mixing tank 70 has a liquid level detector to check the level of the stored solution, and it can be arranged to detect an upper limit, lower limit and bottom limit, for example, and output a signal to a controller 100. Based on such signals, the controller 100 controls the liquid level such that, when the liquid surface is at the lower limit, pumps 72, 74 and flow control valves 76, 78 are operated to raise the level or stop filling when the upper limit is reached. Also, when the bottom limit is reached, an alarm is sounded and signals to stop polishing are outputted.

Operation of the polishing apparatus P of such a construction will be explained. Circulation pump 80 is activated and controlled so that the internal pressure of the fluid detected by the pressure sensor 82 remains above a threshold value to overcome internal resistance in the piping, and keep the solution circulating inside the pipes constantly. Therefore, when the polishing system is in operation, polishing solution is constantly circulated within the pipe 60, thereby preventing changes in solution concentration caused by stagnation and blocking of the circulation pipe 60 due to precipitation of solid particles.

When the polishing apparatuses P are activated, each control device outputs flow rate command signals to the drive section for the peristaltic pump 48 and flow control valve 50 to operate at a pre-determined flow rate, thereby permitting polishing solution to flow at a given rate from the circulation pipe 60 to delivery pipe 46 to deliver polishing solution to the solution nozzle 38. Regardless of the operating or nonoperating state of individual polishing apparatuses P, or changes in the tank solution level that can cause fluctuations in solution flow rate, the solution supply device 36 controls the internal pressure in the circulation pipe 60 within a certain range. In each of the polishing apparatus P, because each apparatus P is provided with its dedicated suction pump 48, even if the internal pressure in the circulation pipe 60 varies widely, the solution flow rate can be kept constant by overcoming the effects of fluctuations. Flow pulsation caused by peristaltic pump 48 is smoothed out by the actions of the flow control valve 50 and accumulator 52. Thus, the flow control valve 50 and the accumulator 52 function as a smoother for smoothing out pulsations of the polishing solution flowing through solution delivery pipe 46.

Accordingly, in the present polishing system, by providing suction pumps 48 for each polishing apparatus, the number of polishing apparatuses that can be supplied by one solution supply device 36 is increased significantly, thereby enabling reduction in equipment and space costs by reducing the required number of solution supply devices 36. Also, conditions of the polishing solution delivered are made more uniform in different polishing apparatuses P, thereby reducing quality variation of polished wafers from lot to lot by increasing the uniformity of polishing conditions in individual apparatuses P.

It is not necessary to have a high capacity circulation pump 80, and therefore, it is possible to prevent inefficiencies of operating a high capacity circulation pump 80 at low flow rates when only a small number of polishing apparatuses P are in operation.

Based on the arrangement presented in this embodiment, flow sensors may be provided in the path of solution delivery pipe 46 so that the peristaltic pump 48 and flow control valve 50 may be controlled by feedback signals. This type of arrangement will enable control of each polishing apparatus P individually to suit different polishing requirements of workpieces. This will enable more precise polishing to be provided by improving responsiveness of the polishing system.

In the above embodiment, the circulation pump 80 is provided in the solution supply device 36, but, because suction pumps 48 are provided for each polishing apparatus P, solution may be delivered directly from the mixing tank 70 to each apparatus P, depending on the number of operating apparatuses P and their locations without using the circulation pump 80. The polishing system may be simplified by not providing a liquid transport pump for the solution supply device 36.

Also, in the above explanation, the relative large polishing system is provided by arranging a large number of polishing apparatuses in parallel, but it is obvious that the present polishing apparatus is equally suitable for a small-scale operation having a few polishing apparatuses. In other words, this invention provides a polishing apparatus of high adaptability usable if accompanied by a suitable polishing solution source.

INDUSTRIAL APPLICABILITY

The present invention is useful as a polishing apparatus for providing a mirror polished surface on a substrate in a manufacturing process of a semiconductor wafer or liquid crystal display.

What is claimed is:

1. A polishing apparatus comprising:

a polishing section for polishing a workpiece by pressing the workpiece against a polishing tool;

a solution piping assembly associated with said polishing section and to be connected to an external solution supply device for transferring a polishing solution from the external solution supply device to said polishing section; and a solution suction device associated with said polishing section and provided in said solution piping assembly for introducing the polishing solution from the external solution supply device to said polishing section at a desired flow rate;

wherein said solution piping assembly includes a smoother for smoothing out pulsations of the polishing solution flowing through said solution piping assembly.

2. The polishing apparatus according to claim 1, wherein said solution piping assembly includes a flow control device for adjusting a flow rate of the polishing solution flowing through said solution piping assembly.

3. The polishing apparatus according to claim 1, wherein said solution suction device comprises a peristaltic pump.

4. The polishing apparatus according to claim 3, wherein said smoother comprises a flow control valve and an accumulator positioned between said peristaltic pump and said polishing section.

5. The polishing apparatus according to claim 1, wherein said smoother comprises a flow control valve and an accumulator positioned between said solution suction device and said polishing section.

6. The polishing apparatus according to claim 1, wherein said solution piping assembly includes a stem pipe through which the polishing solution can be continually flowed.

7. A polishing unit comprising a polishing apparatus, a storing section for storing a workpiece, a transporting device for transporting the workpiece between said polishing apparatus and said storing section, said polishing apparatus including:

a polishing section for polishing the workpiece by pressing the workpiece against a polishing tool;

a solution piping assembly associated with said polishing section and to be connected to an external solution supply device for transferring a polishing solution from the external solution supply device to said polishing section; and a solution suction device associated with said polishing section and provided in said solution piping assembly for introducing the polishing solution from the external solution supply device to said polishing section at a desired flow rate;

wherein said solution piping assembly includes a smoother for smoothing out pulsations of the polishing solution flowing through said solution piping assembly.

8. The polishing apparatus according to claim 7, wherein said smoother comprises a flow control valve and an accumulator positioned between said solution suction device and said polishing section.

9. The polishing apparatus according to claim 7, wherein said solution piping assembly includes a stem pipe through which the polishing solution can be continually flowed.

10. The polishing apparatus according to claim 7, further comprising a flow control device for adjusting a flow rate of the polishing solution flowing through said solution piping assembly.

11. The polishing apparatus according to claim 7, wherein said solution suction device comprises a peristaltic pump.

12. The polishing apparatus according to claim 11, wherein said smoother comprises a flow control valve and an accumulator positioned between said peristaltic pump and said polishing section.

13. A polishing system comprising a plurality of polishing apparatuses, a solution supply device, a solution distribution pipe for distributing a polishing solution from said solution supply device to said plurality of polishing apparatuses, each of said plurality of polishing apparatuses comprising:

a polishing section for polishing a workpiece by pressing the workpiece against a polishing tool;

a solution piping assembly associated with said polishing section and connected to said solution distribution pipe for transferring a polishing solution from said solution distribution pipe to said polishing section; and a solution suction device associated with said polishing section and provided in said solution piping assembly for introducing the polishing solution from said solution supply device to said polishing section at a desired flow rate;

wherein said solution distribution pipe includes a stem pipe through which the polishing solution can be continually flowed.

14. The polishing apparatus according to claim 13, further comprising a flow control device for adjusting a flow rate of the polishing solution flowing through said solution piping assembly.

15. The polishing apparatus according to claim 13, wherein said solution suction device comprises a peristaltic pump.

16. The polishing apparatus according to claim 15, further comprising a smoother for smoothing out pulsations of the polishing solution flowing through said solution piping assembly.

17. The polishing apparatus according to claim 16, wherein said smoother comprises a flow control valve and an accumulator positioned between said peristaltic pump and said polishing section.

18. The polishing apparatus according to claim 13, further comprising a smoother for smoothing out pulsations of the polishing solution flowing through said solution piping assembly.

19. The polishing apparatus according to claim 18, wherein said smoother comprises a flow control valve and an accumulator positioned between said solution suction device and said polishing section.

* * * * *

UNITED STATES PATENT AND TRADEMARK OFFICE

CERTIFICATE OF CORRECTION

PATENT NO. : 6,413,154 B1
DATED : July 2, 2002
INVENTOR(S) : Tetsuji Togawa et al.

It is certified that error appears in the above-identified patent and that said Letters Patent is hereby corrected as shown below:

Title page,
Item [30], change "10-123924" to -- 10-23924 --.

Signed and Sealed this

Tenth Day of December, 2002

JAMES E. ROGAN
*Director of the United States Patent and Trademark Office*